United States Patent [19]

Dallolio

[11] Patent Number: 4,541,236

[45] Date of Patent: Sep. 17, 1985

[54] DEVICE FOR SENSING THE TENSION IN THE INDIVIDUAL THREADS IN A STRANDING MACHINE

[75] Inventor: Giorgio Dallolio, Segrate, Italy

[73] Assignee: Redaelli Tecna Meccanica S.p.A., Dervio, Italy

[21] Appl. No.: 532,152

[22] Filed: Sep. 14, 1983

[51] Int. Cl.[4] ..... D01H 13/16

[52] U.S. Cl. ..... 57/264; 57/93

[58] Field of Search ..... 57/1 R, 3, 6, 58.83, 57/58.86, 78, 80, 81, 82, 92, 93, 264, 265, 352; 242/147 R

[56] References Cited

U.S. PATENT DOCUMENTS

| | | | |
|---|---|---|---|
| 3,345,812 | 10/1967 | Pickering | 57/81 |
| 3,576,560 | 4/1971 | Vermeulen | 57/81 X |
| 3,672,143 | 6/1972 | Whitney | 57/264 |
| 3,840,869 | 10/1974 | Pugh | 57/81 X |
| 4,392,342 | 7/1983 | Meijer | 57/264 |

FOREIGN PATENT DOCUMENTS

| | | | |
|---|---|---|---|
| 3139415 | 4/1983 | Fed. Rep. of Germany | 57/264 |

*Primary Examiner*—Donald Watkins

*Attorney, Agent, or Firm*—Cushman, Darby & Cushman

[57] ABSTRACT

This invention relates to a sensor device able to provide, without contact, an exact indication of the tension in the free portion of each individual thread which leaves the rotating head of a stranding machine in order to contribute to the formation of a rope.

8 Claims, 2 Drawing Figures

DEVICE FOR SENSING THE TENSION IN THE INDIVIDUAL THREADS IN A STRANDING MACHINE

Figure 1:
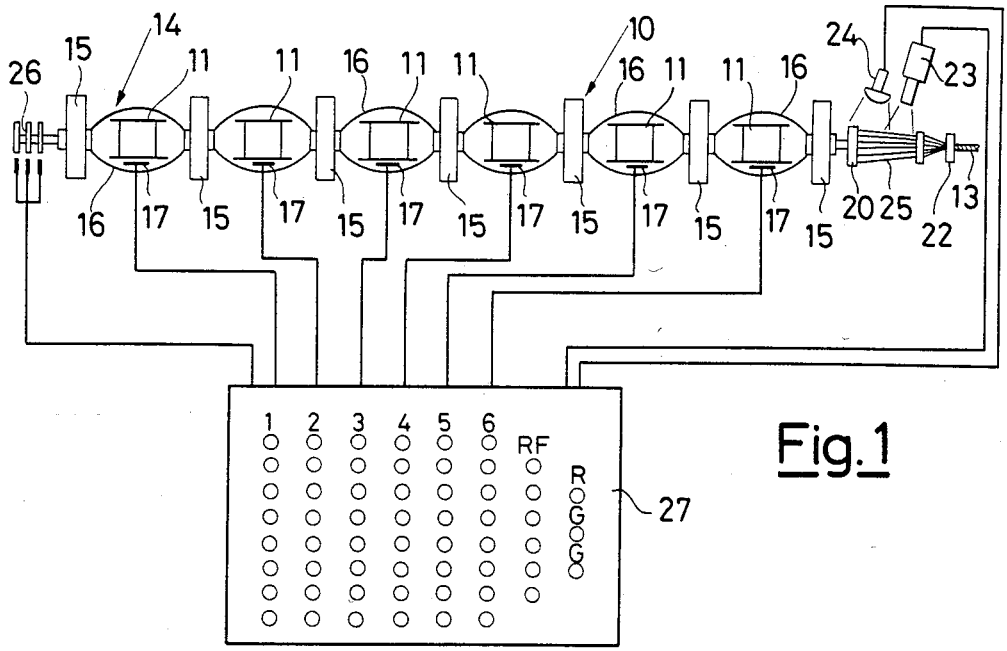

Stranding machines are used for the production both of a simple rope, known as a strand, composed of several threads spirally wound about the same axis, and of a composite rope, is formed by winding together several strands, the generic term "thread" also including herein each individual strand used for the formation of a composite rope, or cable.

Stranding machines are generally provided with individual reels which continuously feed the threads to a rotating head, which winds them spirally about the same longitudinal axis of symmetry to form the rope, which is then wound on to storage reels.

One of the fundamental technical problems in stranding is to give all the threads reaching the rotating head the same predetermined tension in order to obtain a rope with optimum and uniform mechanical characteristics.

A solution to this problem is proposed in Italian patent application No. 19989 A/79.

This patent uses individual devices for each individual thread being wound to form the rope, and which, in the form of feelers constituted by transmissions which yield under the action of the pull of the threads, sense the tension and, if necessary, act by way of electrical controls in order to adjust the braking of the individual thread feed reels.

The devices of the type described in the said patent have limits deriving both from the type of operation and from the type of application.

Such a tension sensing system requires a number of devices equal to the number of threads which pass through the rotating head, and their essentially mechanical structure means that inertia and friction are involved which, even if of modest levels, can falsify the measurement.

Moreover, in order to fit said devices, it is necessary to modify the rotating head, or more precisely the rotating heads when producing different ropes, and these heads must necessarily be able to accept the overall size of the transmissions which operate as tension sensors.

The object of the invention is to provide a thread tension sensor device which gives more satisfactory results than those obtained in the known art, and which at the same time can be extremely simply constructed and assembled without having to carry out extensive work on the stranding machine.

To this end, the invention utilises the fact that in high-speed stranding machines, the threads leaving the rotating head and entering the rope die are stressed by high centrifugal forces. These centrifugal forces cause the free ends of the threads to form a type of loop.

By monitoring the extent of the deflection in a portion of said loop of each thread, the device according to the invention enables the tension in the individual threads to be verified.

There is also the advantage of sensing the tension in any number of threads independently of the type of stranding machine, and without having to make substantial modifications to already existing machines.

More specifically, the present invention provides a device for sensing the tension in the free portion of the individual threads which in a stranding machine leave the rotating head to contribute to the formation of a rope, and which are fed from a series of reels provided with tension regulating means, characterised by comprising a sensor for sensing the spatial position of an intermediate zone of the free thread portion for a predetermined angular position of the rotating head, means for activating said sensor when each thread has been moved into a position corresponding with said sensor by the rotation of the head, and control means which respond to the position signal sensed by the sensor.

Figure 2:
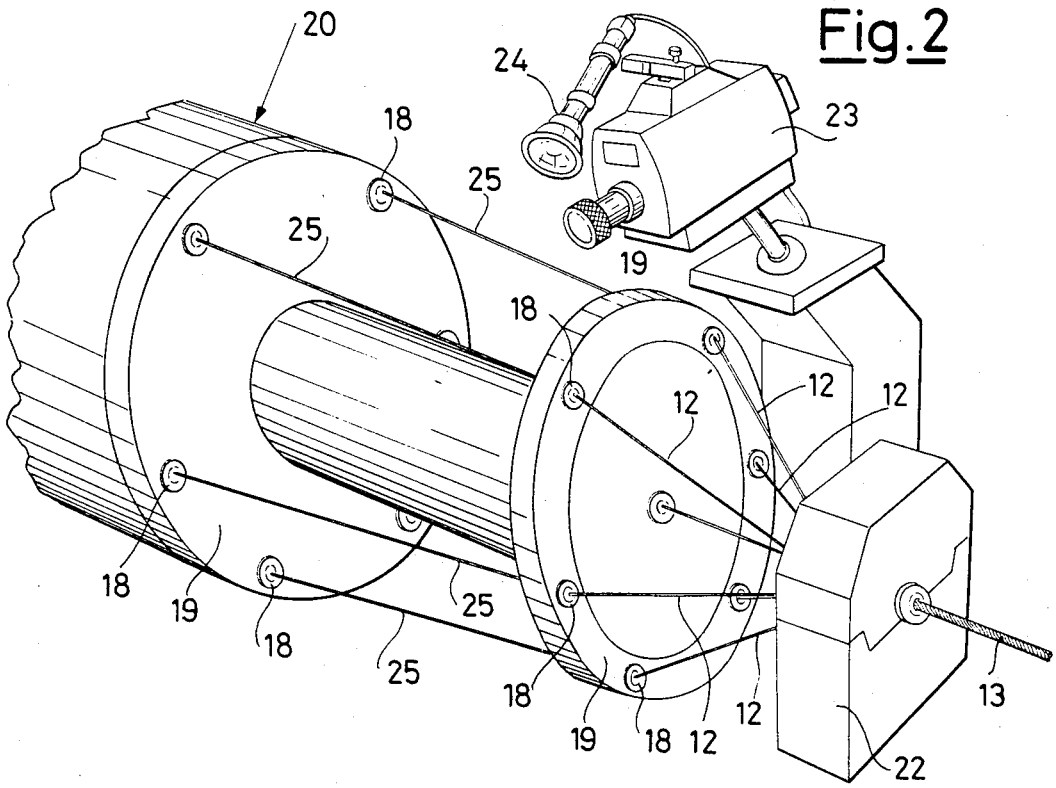

The structural and operational characteristics of the thread tension sensing device according to the present invention will be apparent from the accompanying diagrammatic drawings, in which:

FIG. 1 shows the general scheme of a stranding machine provided with the device according to the invention, and FIG. 2 is a perspective view of that portion of the machine of FIG. 1 in which the device is mounted.

With reference to the drawings, FIG. 1 shows a stranding machine 10 in which there is mounted a series of feed reels 11 for the threads 12 which contribute to the formation of a rope 13. The reels 11 are mounted in cradles 14 supported by supports 15, and the thread 12 leaving each reel 11 crosses the subsequent reels on rotating guides 16. Each reel 11 is also provided with a braking device 17.

All the threads 12 from the individual reels 11 pass through bores 18 provided in thread guide rings 19 (FIG. 2) forming part of a rotating head 20, which winds said threads spirally about the same axis of symmetry 21 at the inlet to a die 22.

Stranding machines of this type are fully known and it is therefore not necessary to describe their constructional characteristics more fully.

A telecamera 23 together with a lamp 24 (FIG. 2) are mounted in a position corresponding with the zone lying between the two thread guide rings 19, where the threads 12 define a free or "flying" portion 25.

Said telecamera 23 senses the image of free thread portions 25 which successively pass into its field of vision, and feeds the sensed image to processor means 27 the instant it is activated by a discriminator member for the individual threads 26.

Said processor means 27 are able to emit signals which are a function of the position of the thread portion 25 in the field of vision of the telecamera 23.

Said processor devices are known and will not be described in greater detail.

On the basis of the position of the thread portion 25, the processor means 27 are able to emit a signal for displaying said sensed position, and to feed a proportional braking signal to the devices 17 positioned on the individual reels 11.

Said signals can be emitted either simultaneously or separately, and enable the correctness of operation of the stranding machine to be judged instant by instant.

The use of sensing means in the form of a telecamera device 23 with processing of the image signal is not critical for the invention, in that any other type of sensor which senses the spatial position of the thread at a predetermined instant and for a given machine position can be used instead.

A sensor of capacitive or inductive type can therefore be used for this purpose, without leaving the scope of the invention.

All these cases satisfy the object of providing a sensing device which does not make contact with the threads and which can also be fitted to already operating stranding machines, without large modifications being necessary.

I claim:

1. A device for sensing the tension of threads in a rotating head of a stranding machine of the type in which thread is fed from a plurality of reels provided with tension regulating means and having a free portion for the thread on the rotating head, said device comprising a sensor for sensing spacial deflection of said free portion at a predetermined angular position of the rotating head, a means for activating said sensor when a thread is in a position corresponding to said angular position of the rotating head, and a control means capable of responding to a signal produced by the sensor corresponding to said spacial deflection.

2. A device as claimed in claim 1, characterised in that the sensor is of optical type.

3. A device as claimed in claim 2, characterised in that said sensor is a telecamera which senses an image of the free thread portions and feeds it to said control means.

4. A device as claimed in claim 1, characterised in that the sensor is of capacitive type.

5. A device as claimed in claim 1, characterised in that the sensor is of inductive type.

6. A device as claimed in claim 1, characterised in that the sensor is at least one proximity switch.

7. A device as claimed in claim 1 wherein the control means responds to the signal from the sensor to operate said tension regulating means of the thread.

8. A device for sensing the tension of moving threads in a rotating head of a stranding machine, the stranding machine being of the type in which thread is fed from a plurality of reels provided with tension regulating means and the threads having a free portion which deflects radially outward under centrifugal forces by the rotating head, the device comprising a sensor for producing a signal corresponding to radial deflection of the free portion of a thread at a predetermined angular position of the rotating head, a means for activating the sensor at said predetermined angular position, and a control means capable of responding to said signal.

* * * * *